United States Patent [19]

Dean

[11] 4,041,305

[45] Aug. 9, 1977

[54] LUMINAIRE USING ONE-WAY MIRROR AS EXTERIOR LENS

[75] Inventor: John Richard Dean, Memphis, Tenn.

[73] Assignee: International Telephone and Telegraph Corporation, New York, N.Y.

[21] Appl. No.: 700,461

[22] Filed: June 28, 1976

[51] Int. Cl.[2] ..... F21V 13/00

[52] U.S. Cl. ..... 240/92; 240/3; 240/25; 240/84

[58] Field of Search ..... 240/92, 81, 84, 108 R, 240/10 R, 25, 3

[56] References Cited

U.S. PATENT DOCUMENTS

| | | | |
|---|---|---|---|
| 3,366,785 | 1/1968 | Huber | 240/3 |
| 3,593,014 | 7/1971 | Vesely | 240/3 |
| 3,610,918 | 10/1971 | Barlow | 240/10 R |
| 3,666,934 | 5/1972 | Moore | 240/3 |
| 3,833,804 | 9/1974 | Vesely | 240/84 X |

*Primary Examiner*—Richard L. Moses
*Attorney, Agent, or Firm*—J. B. Raden; M. M. Chaban

[57] ABSTRACT

Disclosed is an outdoor luminaire employing as its external lens, panels of one-way reflecting glass. During the day, or with the interior lamp unlit, the panels provide an opaque outer surface reflective of the surroundings. With the lamp lit, the panels act merely as lenses passing the light emitted by the interior lamp. In order to make the luminaire opaque, diagonal baffles are provided to extend from each corner of the luminaire toward the lamp and lamp prismatic refractor. These baffles tend to produce four separate compartments with opaque interior walls to prevent the lamp and internal components from being visible when the lamp is unlit. By making the baffles reflective, a further enhancement of the internal masking is effected while further enhancing the optical characteristics of the luminaire when lit.

9 Claims, 8 Drawing Figures

LUMINAIRE USING ONE-WAY MIRROR AS EXTERIOR LENS

BACKGROUND OF THE INVENTION

Luminaire for use in what is called exterior architectural lighting is designed to provide a styled appearance to harmonize with buildings of various types and shapes. With the recent advent of reflective glass as a major architectural material for buildings, use of similar glass as the lens for luminaires has been proposed. For example, U.S. Pat. No. 3,937,948 issued Feb. 10, 1976 shows one such development for a triangular luminaire; however, the stated purpose of this patented design is to effect multiple images of the light source.

SUMMARY OF THE INVENTION

The invention is directed to a luminaire having an essentially rectangular, hexagonal or octagonal cross-section and using as the exterior lens on each of the four sides, a panel of reflective glass to produce what is sometimes called a "one-way" mirror effect.

To produce the "one-way mirror" effect it is preferable that the interior of the luminaire be rendered opaque. Otherwise, the luminaire may be transparent to one viewing the luminaire from particular angles, and the interior components may also be visible from various angles.

To overcome these problems, a series of baffles are disposed radially of the light source or lamp to render the interior of the luminaire opaque to light from the exterior of the luminaire. These baffles are opaque and preferably should be extending from the lamp to the corners of the luminaire.

It is therefore an object of the invention to provide a luminaire having at least four one-way mirror panels as the external lenses of the luminaire.

It is a further object of the invention to provide a luminaire of generally rectangular cross-section with one-way reflecting panels comprising the walls making up the cross-section.

It is a still further object of the invention to provide a luminaire having one-way reflecting external lens and further including baffles extending radially to the luminaire lamp to the borders of the respective lens.

It is a further object of the invention to provide a luminaire having a one-way reflecting panel spaced from the internal light source of the luminaire with a pair of reflective baffles radially disposed from the light source axis to substantially the lateral ends of the reflecting panel to render the space enclosed by the panel and baffles substantially opaque to exterior light.

DETAILED DESCRIPTION OF THE DRAWINGS

Figure 2:
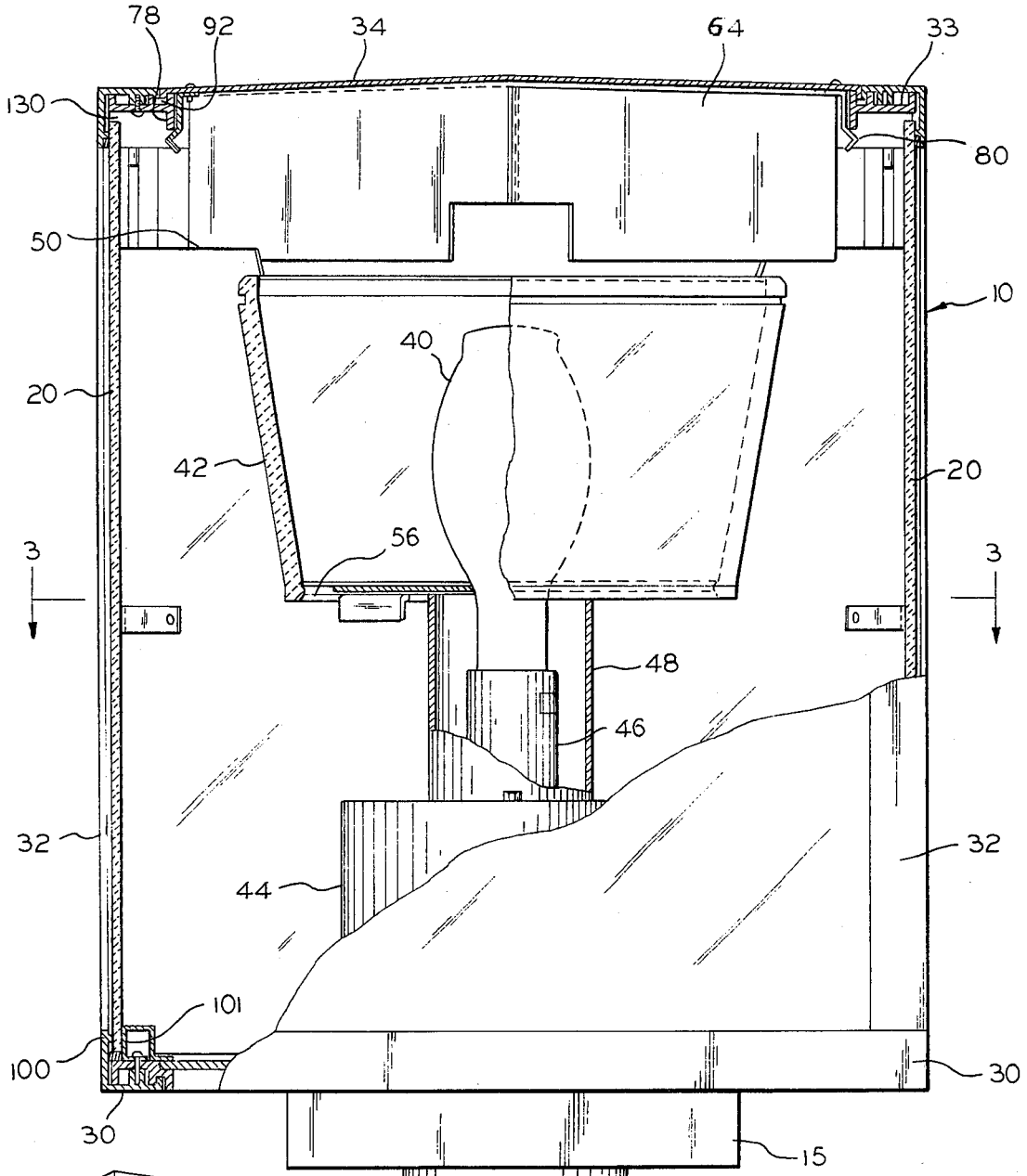
FIG. 2 is a side view in elevation partially broken away of the luminaire of FIG. 1.
Figure 1:
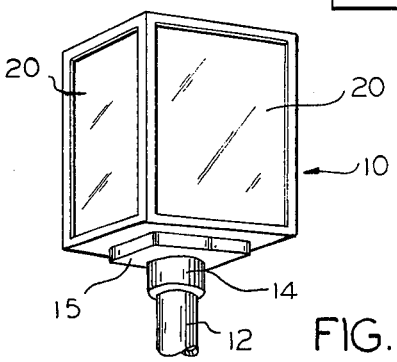
FIG. 1 is a perspective view of a luminaire employing my invention.
Figure 3:
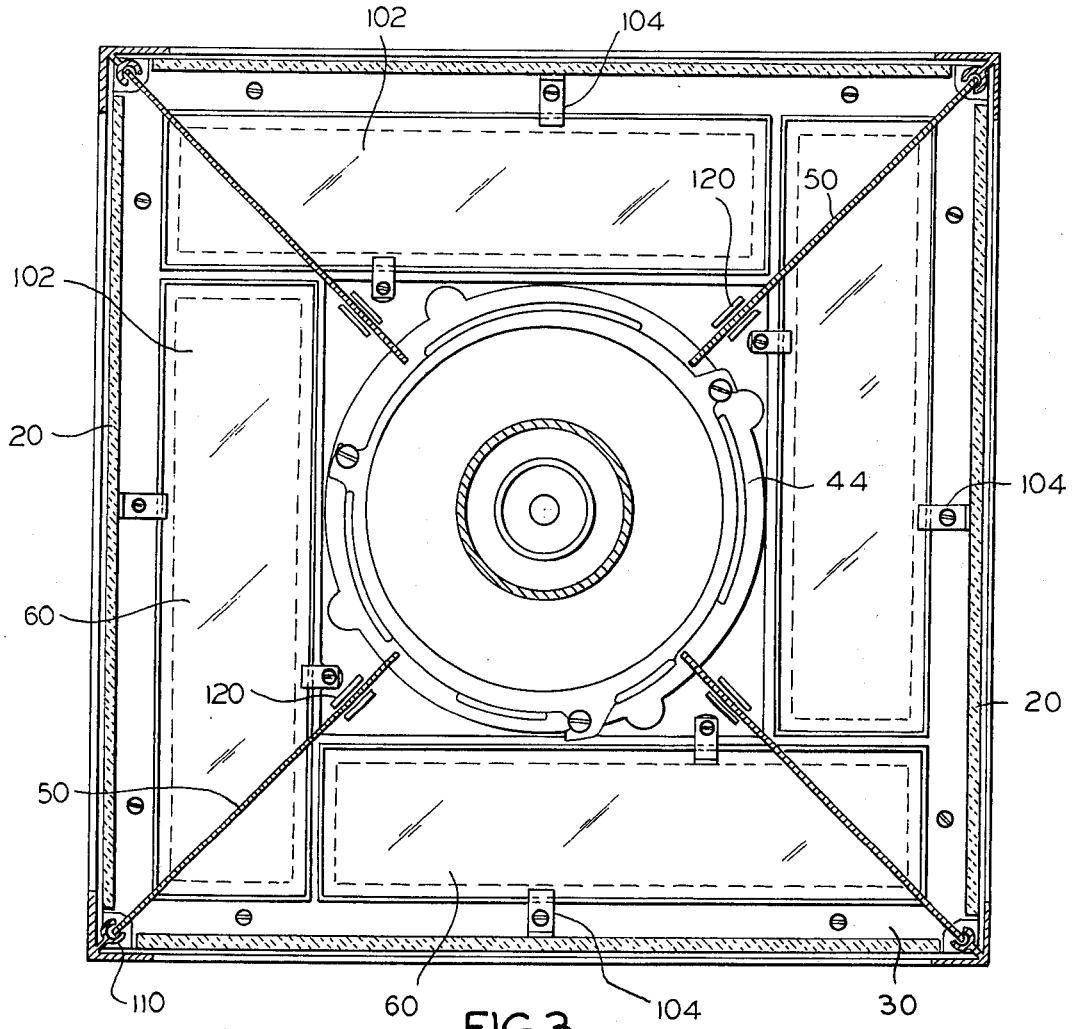
FIG. 3 is a sectional view taken along line 3—3 of FIG. 2.

Turning to the drawings, in FIGS. 1–3, I show a luminaire 10 employing my invention. The luminaire is essentially rectangular in cross-section and is also generally rectangular in its external configuration. Other configurations such as octagonal cross-section and tapering profile may also be provided using my invention.

The luminaire 10 will generally be mounted on a pole 12, the pole being either cylindrical, square or rectangular as desired. A conventional hole or slip-fit arrangement may be used to mount the luminaire on the pole, using an enlarged and reinforced flanged, mounting base 14 secured to the pole by bolts or the like (not shown) and the base flange 15 being secured to the underside of the luminaire. The exposed faces or panels of the luminaire, there being four such panels 20, as shown herein, are essentially rectangular plates of one-way mirror or reflective, translucent material of any conventional known type. At the present time, such reflective glass panels may be suitably tinted with a light and heat reflecting coating for light received from exterior of the luminaire. Such glass is sometimes known generically as reflective glass or reflective coated glass and may be purchased from a number of glass manufacturers. As exemplified in FIGS. 1–3, panels 20 shown as being essentially vertically disposed are of the reflective glass material and are mounted to reflect only externally derived light. Light from interior of luminaire will pass through the panel or lens with little light loss.

In FIG. 2, I show the side view of a typical luminaire 10 partially broken away to show the interior thereof. In FIG. 2, the mounting pole is not shown; however, at the base of the luminaire can be seen the mounting base section 14 with bolts 22 for mounting the luminaire on the pole in one of the known conventional fashions. The luminaire, as shown, is comprised of a substantially square base frame 30 and a rectangular, vertically upstanding frame skeleton 32 and a top frame 33. The frame and frame skeleton are manufactured of conventional metallic material and provide the structural rigidity for the luminaire. Slidably fitted within the upright frame 32 and resting on the base frame 30 are the rectangularly disposed mirror panels 20. The external structure is completed by a cover 34 which snap fits into engagement with top frame to enclose the structure against the elements. The cover 34 may be of suitable sheet metal material.

Disposed centrally within the luminaire is a lamp 40 which may be of any suitable type usable and preferably will be either a mercury vapor lamp or a high-pressure sodium lamp of suitable wattage. Spaced outwardly of the lamp is a refractor 42 which may have an inverted frustoconic, prismatic lens of any suitable type to control and diffuse the light emitted by the lamp 42. Within the base frame and beneath the lamp is a ballast housing or can 44 which may be of any conventional shape, performing a known and conventional function, i.e., confining the control and ballast components adjacent the luminaire base. The can 44 shown is a generally cylindrical tubular one which will enclose the necessary control elements and ballast suitable for luminaires. Mounted on the ballast housing 44 is a lamp socket 46 within a socket housing 48, these elements being any conventional socket and socket housing for a particular lamp 40. The ballast housing and socket are conventional sheet metal members which are firmly affixed by screws, bolts and the like to the base frame in any conventional fashion. Being of sheet metal, housings 44 and 46 are opaque and preferably should have their external surface finished with a bright or reflective finish.

Figure 4:
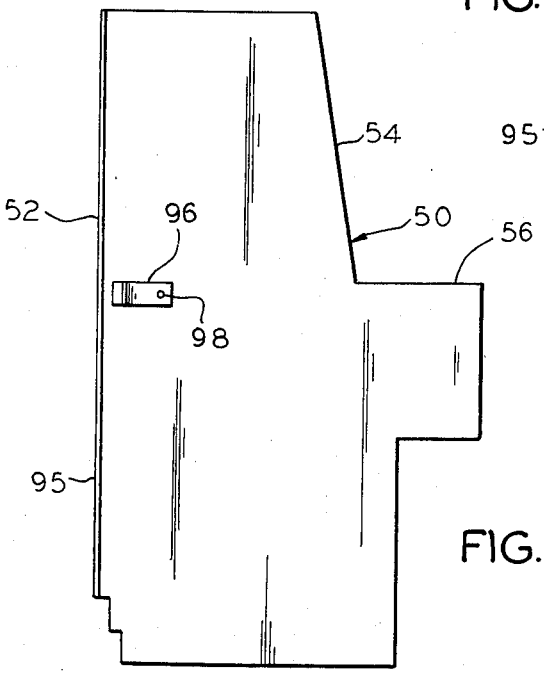
FIG. 4 is a side view in elevation of a baffle as shown in FIG. 2.

Disposed within the luminaire to support the refractor are a set of baffles 50 extending radially outwardly from the refractor as seen best in FIG. 3. As seen best in FIG. 3, the baffles 50 extend radially diagonally from positions adjacent the refractor ballast can and socket housing to the corners of the frame skeleton of the luminaire as will be described. These baffles preferably are of sheet metal with highly reflective or polished external surfaces to act as reflectors for light emitted by the lamp. Suitable other materials could be used for the baffles but in any event the baffles should be opaque, and most effectively should have an external reflective finish. The profile shape of a typical baffle is generally shown best in FIG. 4 with each baffle having a generally straight outer wall 52. Each baffle has a tapering inner wall, the inner wall 54 terminating at a shoulder 56, the shoulder acting as a rest for the refractor 42 when assembled in the luminaire. Thus by providing four equally spaced baffles, four mounting shoulders are provided for the refractor.

The inner wall 54 of the baffle closely conforms to the shape of the inner mounting components of the lamp or luminaire, i.e., the refractor, the ballast housing 44 and socket housing 48. By providing a ballast having an inner contour which is complementary to the shape of the lamp surrounding components, the amount of light emitted from the lamp which escapes from a segment of the refractor into more than one of the compartments 60 formed by two adjacent baffles, is limited.

Figure 6:
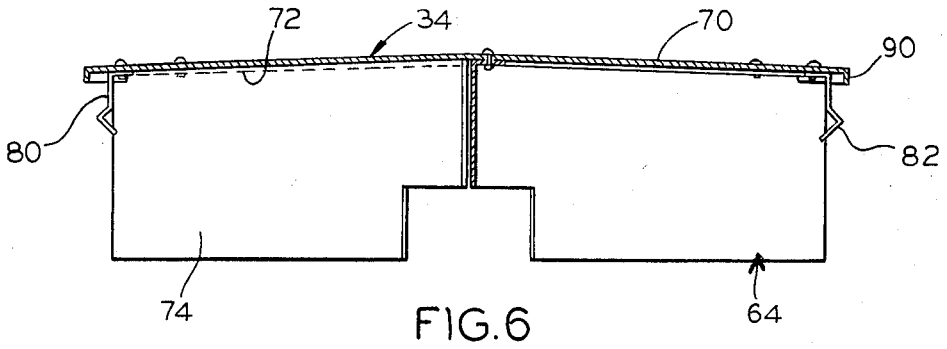
FIG. 6 is a side view in elevation of the cover plate as shown in FIG. 2.
Figure 7:
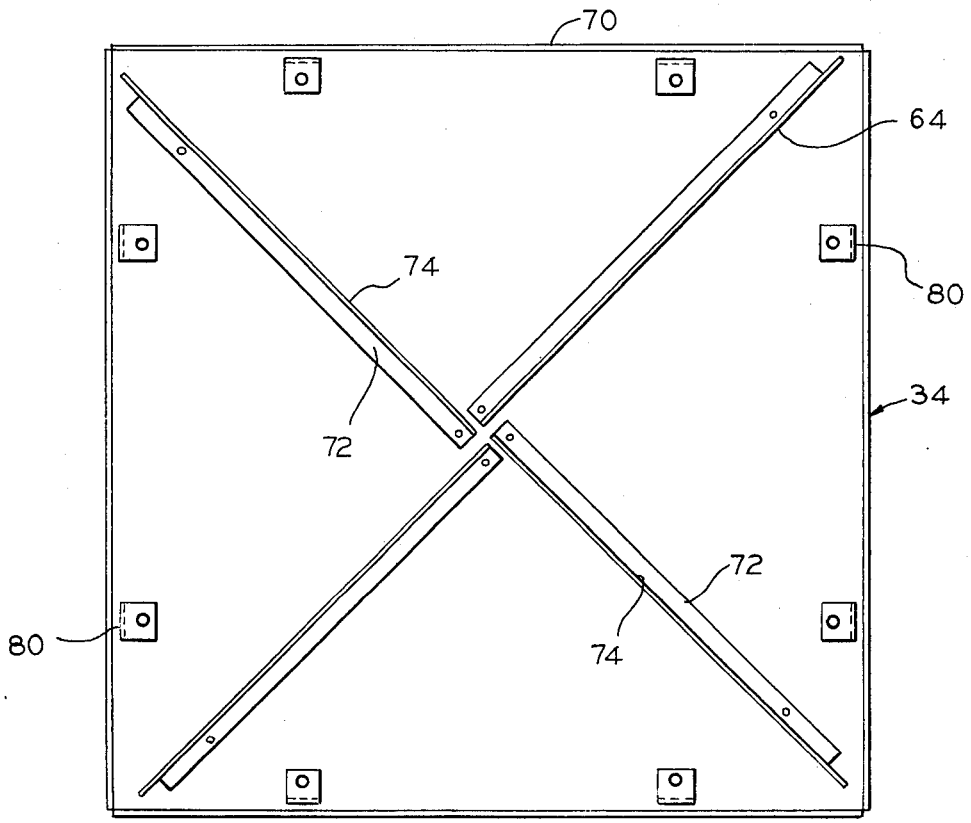
FIG. 7 is a bottom view in elevation of the cover plate of FIG. 6.
Figure 8:
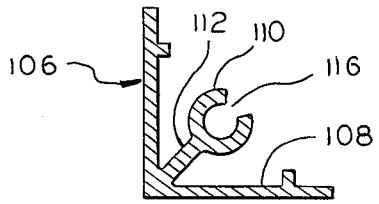
FIG. 8 is a sectional view of a corner support as shown in FIG. 2.

The configuration and compartmentalizing effect of the baffles is essentially continued for the full vertical extent of the luminaire by the use of baffle continuations 64 on the under side of the cover 34. As seen best in FIGS. 6 and 7, the cover has an enclosing, slightly crowned top surface 70 to the underside of which are secured four diagonal baffle continuations 64, the continuations being juxtaposed closely to the respective baffles. These baffle continuations are L-shaped members with a short side 72 riveted or suitable affixed to the cover and vertically extending plates 74 as seen best in FIGS. 2 and 5. The cover 34 mounts within a rectangular or square opening in the top frame 33. The top frame 33 terminates at an inwardly disposed tee shoulder extension 78, one leg of which is engaged by a leaf spring 80 secured to the cover 34. There are two such leaf springs apced along each of the four sides of the cover and these leaf springs have an outwardly directed elbow 82 for engaging and retaining the cover relative to the tee shoulder 78. The tee shoulders extend slightly lower than the top of the mounted mirrored panels, to enable ready removal of the panels, as is well-known in the art. The cover also has a flanged periphery 90 which mates in a suitable depression 92 along the leg of tee 78 for totally enclosing the top surface of the luminaire against the elements.

Figure 5:
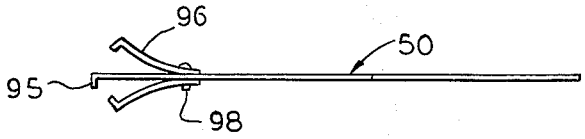
FIG. 5 is a plan view of the baffle of FIG. 4.

To complete the basic explanation of the interior components of the luminaire, reference should be made to FIG. 5 of the drawings, showing a plan view of a typical baffle 50. The baffle is essentially a single sheet of material having its profile in the shape shown in FIG. 4. However, adjacent the outer edge of the baffle is stepped to form vertically extending step 95. Inwardly of the step, the baffle has outwardly directed, tensioned spring members 96 on either side. A single rivet 98 holds the spring members 96 approximately midway on the baffle height, the single rivet mounting allowing rotation of the members about the rivet 98. These spring members act to abut against two mirrored lens panels 20 adjacent to each baffle, thus the spring members act to hold the mirror panels firmly in place (see FIG. 3), as well as to contribute to the support of the baffles.

The bottom of the luminaire may best be seen in FIG. 3. There can be seen the base frame 30 of generally square shape defining the outer portion of the luminaire structure. Mounted inwardly of the frame 30 are four flat panels 102, completing the bottom surface enclosure of the luminaire, the panels being of suitable translucent material such as acrylic. The panels 102 are fastened in place by suitable holding brackets 104, and are arrayed in a band outwardly of the lamp and ballast housing 44.

The base has a peripheral vertical upstanding flange 100 and spaced inwardly therefrom a metal clip 101. The space between the flange 100 and clip 101 serves to receive and support the bottom edge of one of the mirror panels 20.

At each of the corners of the base frame 30 are the respective vertical casting members which adjoin upright frame 32 and which may be joined thereto by suitable corner bolt fastenings. A typical one of these members 106 is shown in cross-section in FIG. 7. Frame member 106 comprises two sheet sections 108 which may be integrally cast or suitably joined, and at the intersection of the sections is an inwardly directed, generally Y-shaped baffle holder 110. The baffle holder 110 has a neck portion 112 joined to the intersection of frame member 106, the neck portion leading to an inwardly open, incomplete annulus. The opening in the annulus is sufficient to receive a baffle 50 and hold the outer end of the baffle firmly in place against horizontal movement. To complete the holding of each baffle, there are provided for each baffle two spaced lugs 120 near the central end of the base frame outward of the ballast housing 44. Lugs 120 upstand vertically a short distance and are paired with a suitable spacing therebetween for holding a baffle 50.

The luminaire as previously described may be readily assembled or disassembled. To disassemble the luminaire, first the cover 34 would be grasped and moved vertically to release the holding effect of the leaf springs 80, and their engagement with the top frame 33. With the cover removed, the frustoconic refractor 42 can be readily raised, freeing it of its engagement with the adjacent baffle wall 54 and from its resting place on the baffle shoulders 56. With the refractor removed, each baffle may be removed individually by raising it vertically a short distance to free the engagement of the lugs 120. Each baffle would be grasped at its inner end and turned through an arc to release the holding effect of flange 95 within the opening 116 of baffle holder 110. With a baffle removed, the side holding effect on the adjacent mirror panels 20 is released and each mirror panel can be raised to free its engagement with upright flanges 100 and clip 101 and thereafter raised through the opening 130 provided by the removal of the cover frame 33, to enable the mirror panel to be removed. Assembly of the luminaire would be essentially by reversing the steps noted.

With a luminaire as set out, the baffles and their counterpart extentions on the cover form essentially four triangular compartments 60, the inner extent of the compartment being formed by the refractor and by the socket housing and baffle housing. With the lamp unlit, the areas internally of the mirror panels are essentially closed and allow little reverse light to reach the inside of a mirror panel. In this way, the mirror panels are rendered substantially opaque to the light from outside of the luminaire. With these compartments and the blockage of light into the luminaire, the compartments, i.e., lamp socket and ballast housing, are not rendered readily visible from the exterior of the lamp. In this way, the mirror effect is maintained. With the lamp lit, the mirror panels act as a normal lens and provide little resistance to light emitted from the light source. The baffles, if reflective, reflect emitted light and further transmit this reflected light to enhance the light emitting characteristics of the luminaire, and provide a continuous complete image of the light source within the luminaire.

In designing the luminaire as shown, it was found that non-reflective baffles, which extend toward the edges of a mirror panel, do not allow the complete optical assembly to be visible when the lamp is lit. With the lamp unlit, and the baffles being non-reflective, the luminaire appears essentially opaque as desired. However, when the lamp is lit, the non-reflective character of the baffles would produce separate compartments with only the light emitted by the refractor passing through the mirrored panels. The baffles would not fill in the spaces between the emitted segments, thereby producing the discontinuous pattern.

By using baffles which are of a reflective nature, directed from a position closely adjacent to the refractor to the corners of the luminaire, a relatively continuous image of the optical assembly is produced.

It should also be noted that if desired, the profile of the luminaire as seen in FIG. 2 could be tapered downwardly to provide a different external appearance.

I claim:

1. A luminaire having a light source enclosed by a plurality of panels for transmitting light from said source, at least one of said panels spaced from said source and reflective of light from outside said luminaire while emitting light from said source when said source is energized, a pair of baffles extending radially from said source toward respective ends of said panel to render said luminaire opaque to light passing into said panel with the light source de-energized.

2. A luminaire as claimed in claim 1, wherein said baffles comprise essentially planar members having reflective surfaces adjoining ends of said panel.

3. A luminaire as claimed in claim 2 wherein each of said baffles comprises a sheet member and extends from an inner terminus adjacent said light source to a termination at a corner of said luminaire adjoining an end of said panel.

4. A luminaire as claimed in claim 1, wherein all of the panels disposed radially outwardly of said light source are reflective of outside light and emissive of light from said source, and each of said panels is spaced from source a like distance, and in which there are paired baffles adjoining each panel, with said baffles disposed radially from said source.

5. A luminaire as claimed in claim 4, in which said light source comprises a lamp mounted on a vertical axis with a frusto-conic refractor disposed concentrically outwardly of said lamp.

6. A luminaire as claimed in claim 5, wherein said luminaire has a rectangular cross section in both the horizontal and vertical planes.

7. A luminaire including a light source for transmitting light when energized through a plurality of lens panels spaced from said light source, each of said panels being reflective of light transmitted from externally of the luminaire with the source deenergized, the invention comprising a plurality of baffles of sheet material each extending radially from said light source to a location adjacent a respective end of one of said panels to render said luminaire essentially opaque to light from exterior of the luminaire.

8. A luminaire as claimed in claim 7, wherein there are four lens panels surrounding said light source with four baffles extending between said light source and said panels.

9. A luminaire as claimed in claim 8, wherein there are spring means on each of said baffles, each of said spring means positioned to engage the adjacent panel end and support said panel within the luminaire.

* * * * *